US006485358B2

(12) United States Patent
Numoto et al.

(10) Patent No.: US 6,485,358 B2
(45) Date of Patent: Nov. 26, 2002

(54) WAFER POLISHING DEVICE

(75) Inventors: Minoru Numoto, Mitaka (JP); Shigeyuki Honma, Mitaka (JP)

(73) Assignee: Tokyo Seimitsu Co., Ltd., Mitaka (JP)

( * ) Notice: Subject to any disclaimer, the term of this patent is extended or adjusted under 35 U.S.C. 154(b) by 0 days.

(21) Appl. No.: 09/977,311

(22) Filed: Oct. 16, 2001

(65) Prior Publication Data

US 2002/0049030 A1 Apr. 25, 2002

(30) Foreign Application Priority Data

Oct. 23, 2000 (JP) ..... 2000-322524
Sep. 20, 2001 (JP) ..... 2001-286847

(51) Int. Cl.[7] ..... B24B 7/22
(52) U.S. Cl. ..... 451/288; 451/41; 451/398
(58) Field of Search ..... 451/288, 287, 451/398, 388, 41

(56) References Cited

U.S. PATENT DOCUMENTS 5,423,558 A * 6/1995 Koeth et al. ..... 451/388
5,941,758 A * 8/1999 Mack ..... 451/41
5,964,653 A * 10/1999 Perlov et al. ..... 451/288
6,068,548 A * 5/2000 Vote et al. ..... 451/398

* cited by examiner

*Primary Examiner*—Robert A. Rose
(74) *Attorney, Agent, or Firm*—Nixon Peabody LLP; David S. Safran

(57) ABSTRACT

In the wafer polishing device, a retainer ring can be attached and detached with ease. Under a retainer ring attaching part disposed on a head body, a retainer ring is attached with a snap ring. The snap ring is divided into two. An upper projection part and a lower projection part are formed on the inner periphery of the snap ring. The upper projection part is fitted to an upper groove formed on the outer periphery of the retainer ring attaching part, and the lower projection part is fitted to a lower groove formed on the outer periphery of the retainer ring. In attachment, the retainer ring is connected to the lower part of the retainer ring attaching part, and the snap ring is placed on the outer periphery of the joint.

7 Claims, 7 Drawing Sheets

WAFER POLISHING DEVICE

BACKGROUND OF THE INVENTION

1. Field of the Invention

The present invention relates to a wafer polishing device for polishing a wafer by Chemical Mechanical Polishing (CMP).

2. Description of the Related Art

In wafer polishing by CMP, polishing is accomplished by pressing a wafer held by a carrier against a polishing pad while supplying a mechano-chemical abrasive to the rotating polishing pad. In this process, the wafer is polished while being surrounded by a retainer ring, and therefore, it is possible to prevent the wafer under polishing from popping out of the carrier.

Since the retainer ring is pressed to the polishing pad together with the wafer, the retainer ring wears out from use. Hence, the retainer ring needs to be replaced periodically.

Conventionally, a retainer ring is bonded to a backing material, which is placed on a carrier, with adhesive and so on. When the retainer ring is replaced, a part of the carrier is removed from a device body and is replaced together with the backing material.

Alternatively, a retainer ring is attached to a retainer ring attaching part, which is formed on a carrier or a head body, using bolts.

However, it is quite troublesome to attach and detach the above conventional configuration for attaching a retainer ring. Hence, replacement of a retainer ring has required much work and a long time.

SUMMARY OF THE INVENTION

The present invention has been developed in view of the above-mentioned circumstances, and its object is to provide a wafer polishing device in which a retainer ring can be attached and detached with ease.

In order to attain the above object, the present invention is directed to a wafer polishing device which polishes a wafer by pressing the wafer against a rotating polishing pad, the wafer polishing device comprising: a wafer holding head having a head body which holds the wafer; and a retainer ring attached to the head body, the wafer being surrounded by the retainer ring, wherein fitting parts are formed respectively on an outer periphery of the head body and an outer periphery of the retainer ring, and a snap ring is fitted to the fitting parts, so that the retainer ring is attached to the head body with the snap ring.

According to the present invention, the retainer ring is in contact with the lower part of the head body and is attached to the head body by fitting the snap ring to the fitting part formed on the outer periphery of the retainer ring and the fitting part formed on the outer periphery of the head body. Hence, the retainer ring can be attached with ease.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Hereunder, a preferred embodiment of a wafer polishing device of the present invention will be described in detail with reference to the accompanying drawings.

Figure 1:
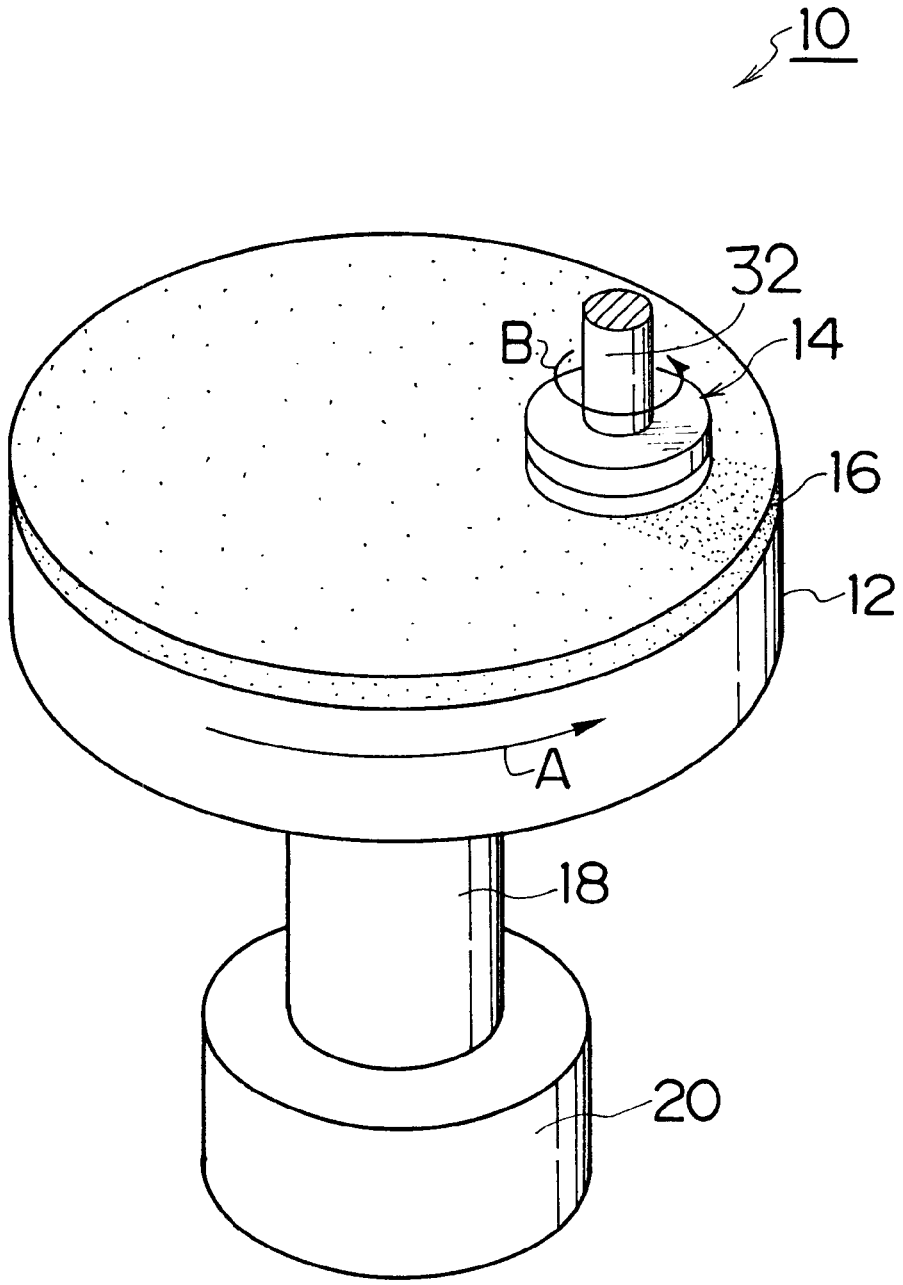
FIG. 1 is a perspective view showing the entire configuration of a wafer polishing device.

FIG. 1 is a perspective view showing the entire configuration of a wafer polishing device 10. As shown in FIG. 1, the wafer polishing device 10 comprises a polishing plate 12 and a wafer holding head 14.

The polishing plate 12 is formed as a disk and a polishing pad 16 is bonded on an upper surface thereof. A spindle 18 is connected to the undersurface of the polishing plate 12, and the polishing plate 12 rotates in a direction of arrow A of FIG. 1 by driving of a motor 20, which is connected to the spindle 18. And then, mechano-chemical abrasive or slurry is supplied to the polishing pad 16 of the rotating polishing plate 12 from a nozzle (not shown).

Figure 2:
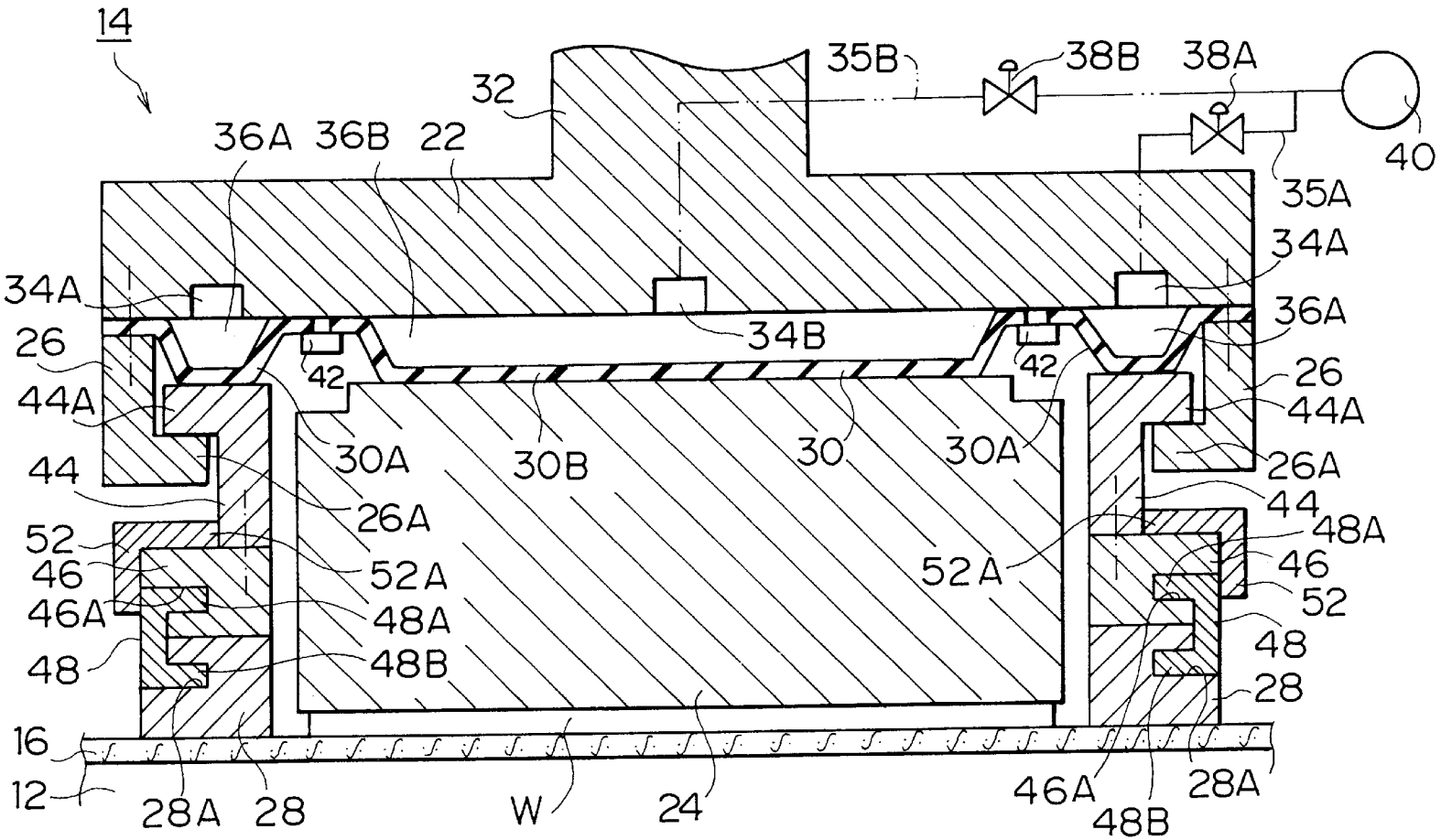
FIG. 2 is a longitudinal section showing the configuration of a wafer holding head.

The wafer holding head 14 is attached in a manner so as to move upward and downward by an elevation device (not shown). As shown in FIG. 2, the wafer holding head 14 comprises a head body 22, a carrier 24, a guide ring 26, a retainer ring 28, and a rubber sheet 30.

The head body 22 is formed as a disk, and a rotation axis 32 is connected to the upper surface thereof. The head body 22 rotates in a direction of arrow B of FIG. 1 by driving of a motor (not shown), which is connected to the rotation axis 32. An air supply path 34A for the retainer ring and an air supply path 34B for the carrier are formed on the head body 22 and are connected to an air pump 40 via an air supply pipe 35A for the retainer ring and an air supply pipe 35B for the carrier, respectively. A pressure control valve 38A for the retainer ring and a pressure control valve 38B for the carrier are disposed on the air supply pipe 35A for the retainer ring and the air supply pipe 35B for the carrier, respectively. Released quantities of the pressure control valve 38A for the retainer ring and the pressure control valve 38B for the carrier are controlled by a controller (not shown) so as to control quantities of compressed air supplied to the air supply path 34A for the retainer ring and the air supply path 34B for the carrier.

The rubber sheet 30 is formed as a disk and has an outer rim sandwiched between the head body 22 and the guide ring 26 and fixed on the undersurface of the head body 22. The rubber sheet 30 is divided into an outer part 30A and a center part 30B by a fastener ring 42. The air supply path 34A for the retainer ring is connected to the outer part 30A. Since compressed air is supplied from the air supply path 34A for the retainer ring, the outer part 30A acts as an air bag 36A for the retainer ring. Meanwhile, the air supply path 34B for the carrier is connected to the center part 30B. Since compressed air is supplied from the air supply path 34B for the carrier, the center part 30B acts as an air bag 36B for the carrier.

The carrier 24 is formed as a cylindrical column and has an upper end face fixed onto the center part 30B of the rubber sheet 30. The retainer ring 28 is attached to a retainer ring attaching part 46 of a press ring 44, which is fixed onto the outer part 30A of the rubber sheet 30, with a snap ring 48.

The press ring 44 is formed as a cylinder and has an upper end face opposed to the outer part 30A of the rubber sheet 30. Further, a flange 44A is formed on the outer periphery of the upper end face of the press ring 44. The flange 44A is engaged on a flange 26A, which is formed so as to project on the inner periphery of the lower end of the guide ring 26. Hence, it is possible to prevent the flange 44A from falling.

The retainer ring attaching part 46 is formed as a ring and is fixed onto the lower end face of the press ring 44. An upper groove (upper depression part) 46A for attaching the retainer ring 28 is formed on the whole outer periphery of the retainer ring attaching part 46. The retainer ring 28 is attached under the retainer ring attaching part 46, and a lower groove (lower depression part) 28A is formed on the whole outer periphery of the retainer ring 28.

Figure 3:
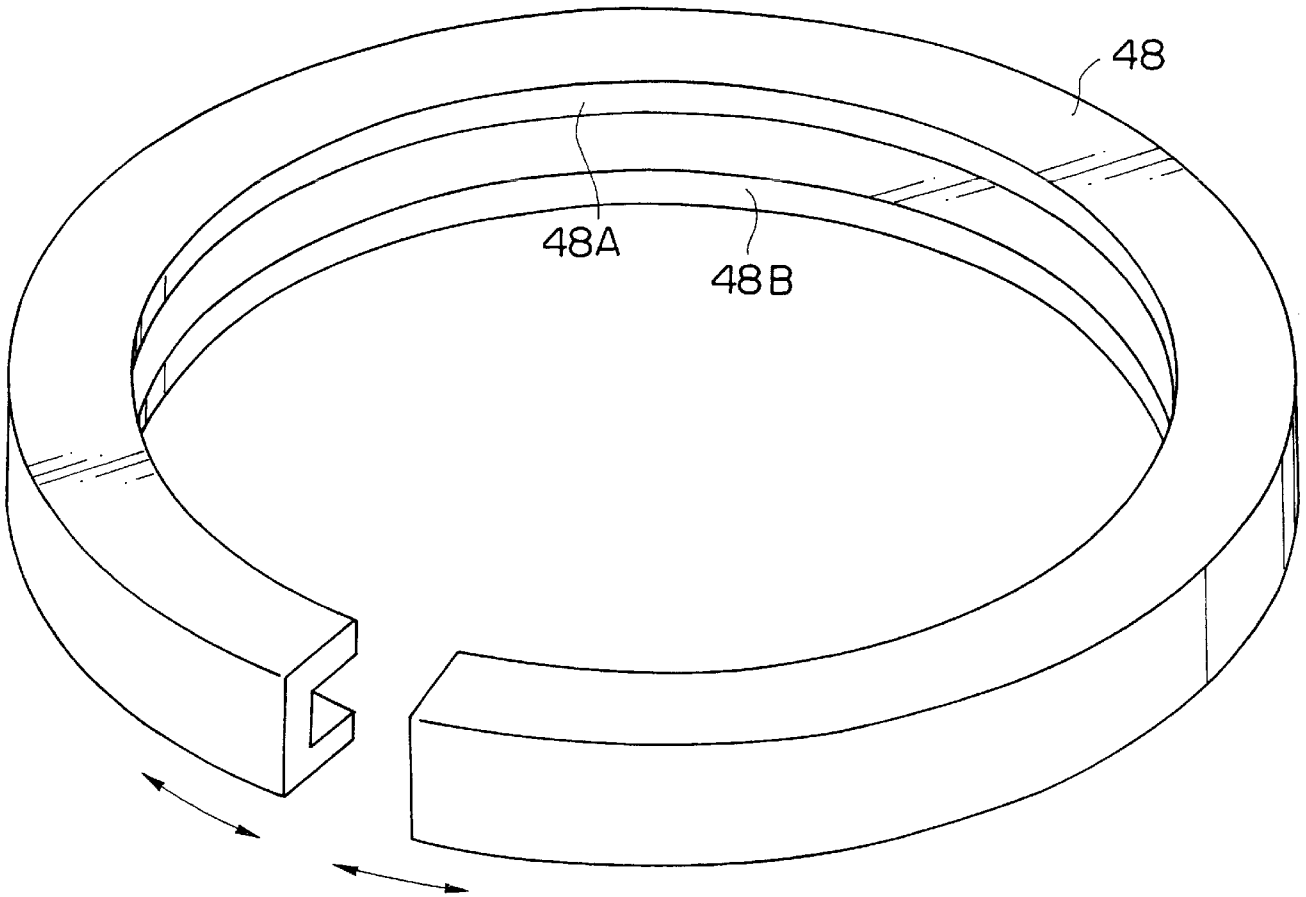
FIG. 3 is a perspective view showing the configuration of a snap ring.

As shown in FIG. 3, the snap ring 48 is a thick C-shaped snap ring. An upper projection part 48A and a lower projection part 48B are formed on the whole inner periphery of the snap ring 48. The snap ring 48 is placed on the outer periphery of the joint of the retainer ring attaching part 46 and the retainer ring 28, the upper projection part 48A is fitted to the upper groove 46A of the retainer ring attaching part 46, and the lower projection part 48B is fitted to the lower groove 28A of the retainer ring 28. Thus, the retainer ring 28 is combined with the retainer ring attaching part 46 and is attached to the retainer ring attaching part 46 without falling.

A snap ring cover 52, which is formed as a tube, is attached on the outer periphery of the snap ring 48. The snap ring cover 52 has an internal diameter substantially equal to an outer diameter of the retainer ring attaching part 46 and is placed so as to slide freely on the outer periphery of the retainer ring attaching part 46. Moreover, a flange 52A is formed on the inner periphery of the upper part of the snap ring cover 52. Since the flange 52A is engaged to the upper surface of the retainer ring attaching part 46, it is possible to prevent the snap ring cover 52 from falling.

The following will discuss a method of polishing a wafer of the wafer polishing device 10 thus configured.

First, a wafer W is held by the wafer holding head 14 and is placed on the polishing pad 16. Next, compressed air is supplied to the air bag 36B for the carrier and the air bag 36A for the retainer ring from the air pump 40. Thus, the air bag 36B for the carrier and the air bag 36A for the retainer ring are inflated, and the wafer W and the retainer ring 28 are pressed onto the polishing pad 16 with a predetermined pressure. Under this circumstance, the polishing plate 12 is rotated in the direction A in FIG. 1 and the wafer holding head 14 is rotated in the direction B in FIG. 1. And then, slurry is supplied onto the rotating polishing pad 16 from a nozzle (not shown). The undersurface of the wafer W is thus polished by the polishing pad 16.

Next, referring to FIGS. 4(*a*) to 4(*d*), a method of attaching the retainer ring 28 will be discussed.

Figure 4:
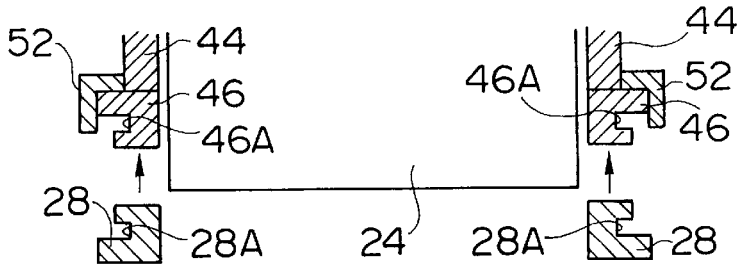
FIGS. 4(*a*), 4(*b*), 4(*c*) and 4(*d*) are explanatory drawings showing a method of attaching a retainer ring.
Figure 4:
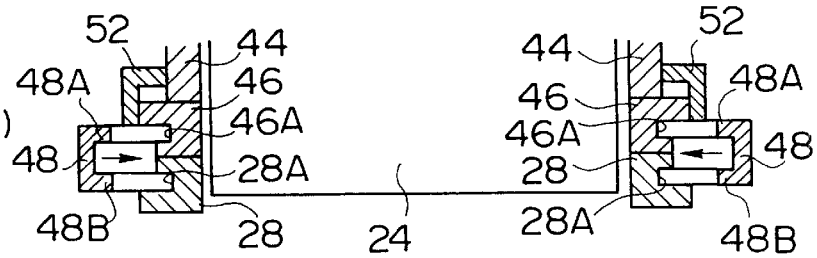
Figure 4:
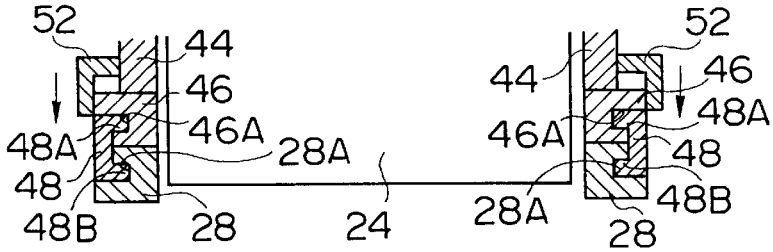
Figure 4:
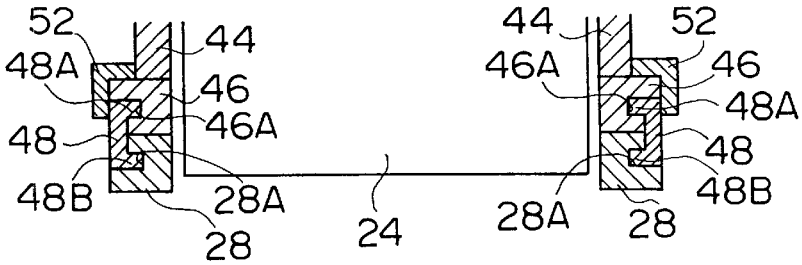

First, as shown in FIG. 4(*a*), the retainer ring 28 is disposed below the retainer ring attaching part 46. And then, as shown in FIG. 4(*b*), the retainer ring 28 is joined to the lower part of the retainer ring attaching part 46.

Subsequently, the snap ring cover 52 is caused to slide upward, and as shown in FIG. 4(*c*), under this circumstance, the snap ring 48 is fitted to the outer periphery of the joint of the retainer ring 28 and the retainer ring attaching part 46. In fitting, the snap ring 48 is expanded, the upper projection part 48A is fitted to the upper groove 46A of the retainer ring attaching part 46, and the lower projection part 48B is fitted to the lower groove 28A of the retainer ring 28. Thus, the retainer ring 28 is attached to the retainer ring attaching part 46.

Next, as shown in FIG. 4(*d*), the snap ring cover 52 is caused to slide downward, and the snap ring cover 52 covers the outer periphery of the snap ring 48.

The outer periphery of the snap ring 48 for fixing the retainer ring 28 is thus covered with the snap ring cover 52, so that the extension of the diameter of the snap ring 48 is regulated, and the retainer ring 28 is prevented from coming off. Thus, the attachment of the retainer ring 28 is completed.

Meanwhile, the retainer ring 28 is detached in the following manner. First, the snap ring cover 52 is caused to slide upward. Subsequently, the snap ring 48 is pressed and expanded to detach the snap ring 48 from the joint. The retainer ring 28 is thereby detached from the retainer ring attaching part 46.

As described above, with the configuration for attaching the retainer ring of the present embodiment, it is possible to attach and detach the retainer ring 28 with a single motion. Therefore, it is possible to readily replace the retainer ring in a short time. The conventional replacing operation has required a long time and much work.

In the present embodiment, the upper projection part 48A and the lower projection part 48B are formed on the whole inner periphery of the snap ring 48. However, the upper projection part 48A and the lower projection part 48B may be formed on a plurality of parts in a circumferential direction at regular intervals, and the upper groove 46A and the lower groove 28A may be formed on a plurality of parts in a circumferential direction at regular intervals in correspondence with the upper projection part 48A and the lower projection part 48B.

Figure 5:
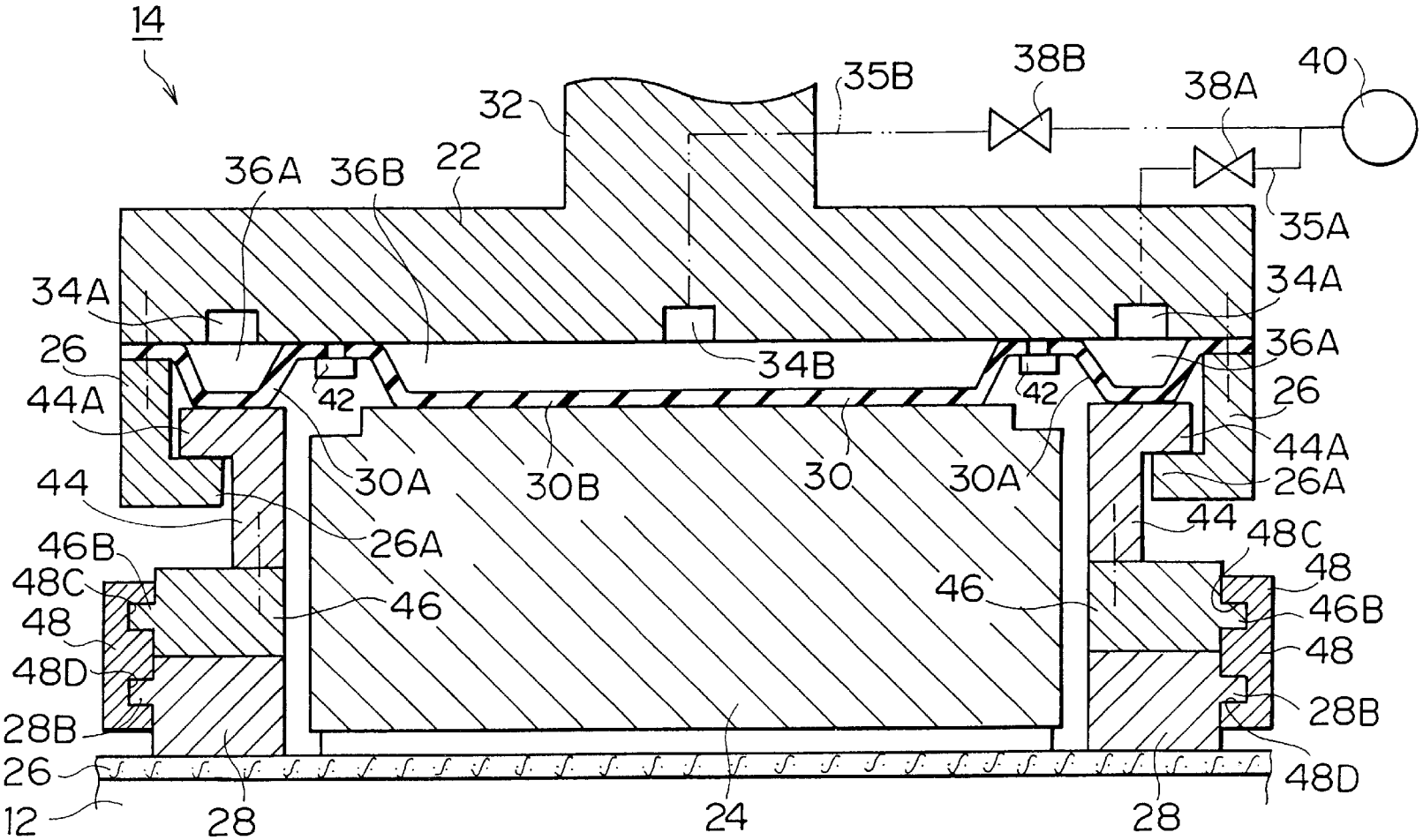
FIG. 5 is a longitudinal section showing the configuration of a wafer holding head according to another embodiment.

Further, in the present embodiment, the upper groove 46A is formed on the outer periphery of the retainer ring attaching part 46, the lower groove 28A is formed on the outer periphery of the retainer ring 28, and the upper projection part 48A and the lower projection part 48B, which are fitted to the grooves, are formed on the inner periphery of the snap ring 48. As shown in FIG. 5, the configuration may be reversed. That is, the upper projection part 46B is formed on the outer periphery of the retainer ring attaching part 46, the lower projection part 28B is formed on the outer periphery of the retainer ring 28, and an upper groove (upper depression part) 48C and a lower groove (lower depression part) 48D, which are fitted to these projection parts, are formed on the inner periphery of the snap ring 48. The above configuration also allows attachment and detachment of the retainer ring 28 with a single motion.

In the present embodiment, the example is discussed in which the present invention is used for the wafer polishing device having the retainer ring 28 attached on the head body 22 via the air bag 36A for the retainer ring. The present invention is also applicable to a wafer polishing device having a retainer ring directly attached to a head body. In this case, an upper depression part (or an upper projection part) is formed on the outer periphery of the head body, a lower depression part (or an upper depression part) is formed on the outer periphery of the retainer ring, and an upper projection part (or an upper depression part) and a lower projection part (or a lower depression part) of the snap ring are fitted to the upper depression part (or the upper projection part) and the lower depression part (lower projection part) to attach the retainer ring.

Furthermore, in the present embodiment, the snap ring cover 52 is disposed on the outer periphery of the retainer ring attaching part 46 so as to slide freely. It is possible to attach and detach the snap ring 48 more readily by providing a holding mechanism to hold the snap ring cover 52 being slid upward.

Figure 6:
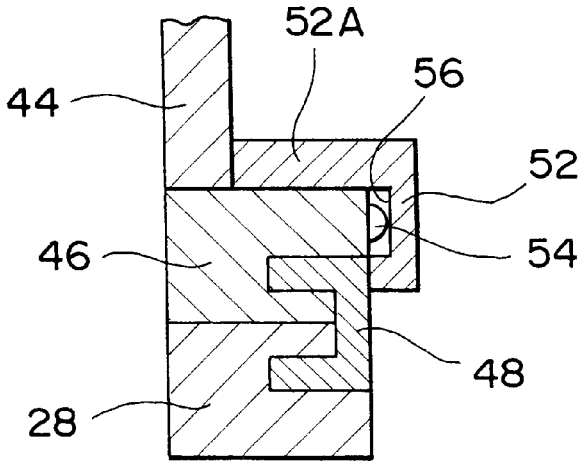
FIGS. 6(*a*) and 6(*b*) are enlarged views of essential parts of a lock mechanism of a snap ring cover according to an embodiment.
Figure 6:
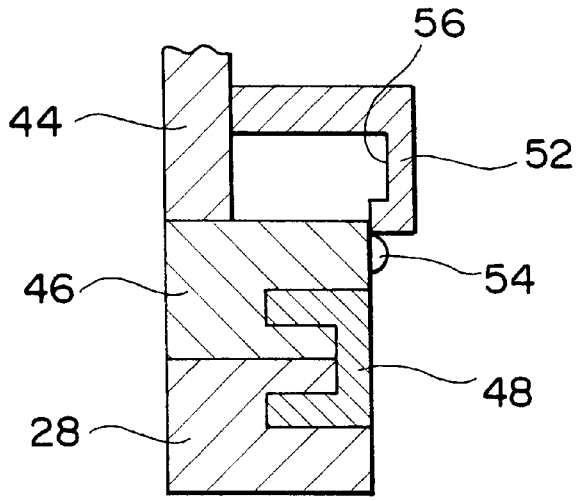

FIGS. 6(*a*) and 6(*b*) show an embodiment of a holding mechanism of the snap ring cover 52.

The snap ring cover 52 is made of a material such as plastic that is capable of elastic deformation, and a groove 56 is formed on the inner periphery of the snap ring cover 52. Meanwhile, three hemispherical protrusions 54, which can be accommodated in the groove 56, are formed at regular intervals on the outer periphery of the retainer ring attaching part 46.

The holding mechanism of the snap ring cover 52 thus configured has the following effect.

When the snap ring cover 52 is lifted with certain power or more from the state shown in FIG. 6(*a*), the lower edge of the groove 56 is elastically deformed and passes on the protrusions 54. Hence, the snap ring cover 52 moves above the protrusions 54.

The snap ring cover 52 being moved above the protrusions 54 has the lower surface engaged to the protrusions 54 as shown in FIG. 6(*b*), thereby prevented from falling. The operator attaches and detaches the snap ring 48 in this state.

After the snap ring 48 is attached, the snap ring cover 52 is pressed downward. When the snap ring cover 52 is pressed downward with specific power or more, the inner periphery of the lower end is elastically deformed and passes on the protrusions 54. Hence, as shown in FIG. 6(*a*), the protrusions 54 are placed into the groove 56, and the flange 52A formed on the snap ring cover 52 is engaged to the upper surface of the retainer ring attaching part 46. And then, the outer periphery of the snap ring 48 is covered with the snap ring cover 52 and the extension of a diameter of the snap ring 48 is regulated.

As described above, since the holding mechanism is provided, which is used when sliding the snap ring cover 52 upward, it is possible to eliminate the need for putting a hand on the snap ring cover 52. Thus, the snap ring 48 can be attached and detached with greater ease.

Figure 7:
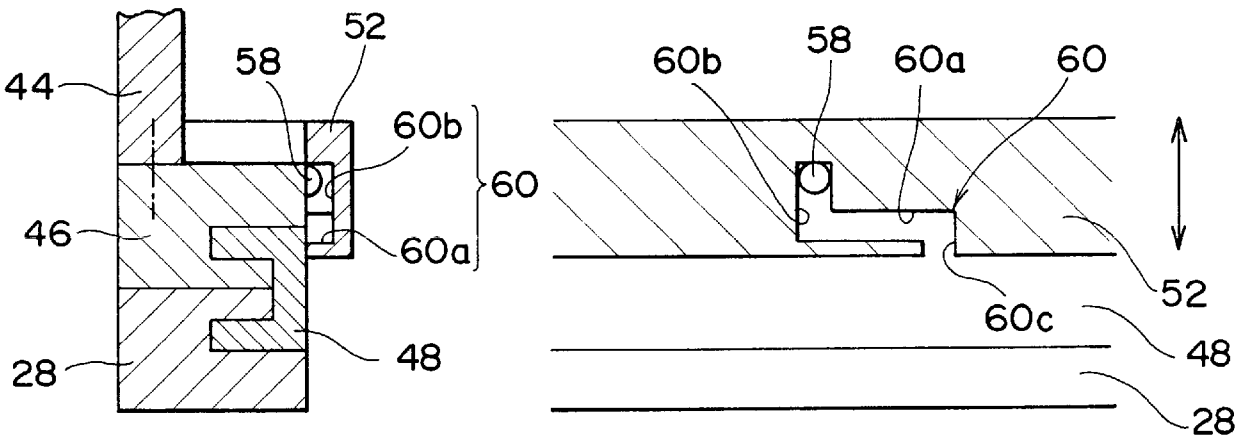
FIGS. 7(*a*) and 7(*b*) are enlarged views of essential parts of a lock mechanism of a snap ring cover according to another embodiment.
Figure 7:
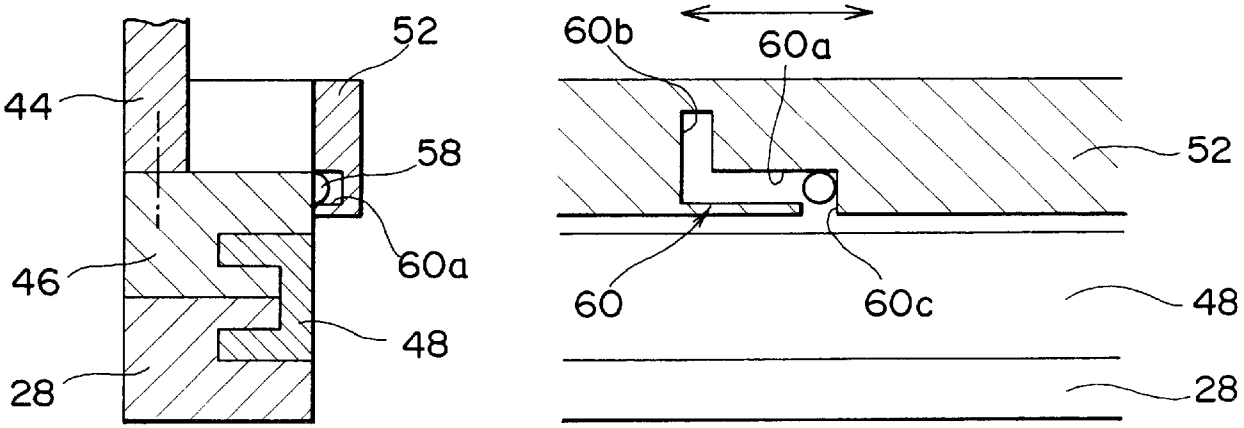

FIGS. 7(*a*) and 7(*b*) show another embodiment of the holding mechanism of the snap ring cover 52.

Three hemispherical protrusions 58 are formed at regular intervals on the outer periphery of the retainer ring attaching part 46. Meanwhile, L-shaped grooves 60 are formed at regular intervals on three places of the inner periphery of the snap ring cover 52. Each of the grooves 60 is composed of a horizontal groove 60*a* and a vertical groove 60*b*. The vertical groove 60*b* is formed upward on an end of the horizontal groove 60*a*. An inlet 60*c* is formed downward on the other end of the horizontal groove 60*a*. Besides, the flange 52A is not formed on the upper part of the inner periphery.

The lock mechanism of the snap ring cover 52 thus configured has the following effect.

First, the protrusions 58 are fitted into the inlet 60*c* of the groove 60, and the protrusions 58 are guided into the horizontal groove 60*a*. Hence, only horizontal rotation of the snap ring cover 52 is allowed. In this state, when the snap ring cover 52 is rotated in the horizontal direction and the protrusions 58 are guided into the vertical groove 60*b*, the snap ring cover 52 can move upward and downward along the vertical groove 60*b*. And then, when the protrusions 58 are guided into the vertical groove 60*b*, as shown in FIG. 7(*a*), the upper end of the vertical groove 60*b* is engaged to the protrusions 58 so as to prevent the snap ring cover 52 from falling. Subsequently, in this state, the outer periphery of the snap ring 48 is covered with the snap ring cover 52.

When the snap ring 48 is detached, first, the snap ring cover 52 is pressed upward in the vertical direction along the vertical groove 60*b*. The protrusions 58 come into contact with the lower end of the vertical groove 60*b* at a certain position, and the snap ring cover 52, which is pressed upward in the vertical direction, is rotated in the horizontal direction when the contact is made. Thus, the protrusions 58 are guided into the horizontal groove 60*a*, and the snap ring cover 52 is moved above the snap ring 48.

When the protrusions 58 are guided into the horizontal groove 60*a*, as shown in FIG. 7(*b*), only horizontal movement is allowed and vertical movement is regulated regarding the snap ring cover 52. Hence, the snap ring 48 is attached and detached in this state.

After the snap ring 48 is attached, the snap ring cover 52 is rotated in the horizontal direction, and the protrusions 58 are guided into the vertical groove 60*b*. Thus, the vertical movement of the snap ring cover 52 is allowed, and as shown in FIG. 7(*a*), the snap ring cover 52 moves downward to a position for covering the outer periphery of the snap ring 48 and stops thereon. Therefore, the extension of a diameter of the snap ring 48 is regulated.

As described above, since the lock mechanism is provided, which is used when sliding the snap ring cover 52 upward, it is possible to eliminate the need for putting a hand on the snap ring cover 52 and to more readily attach and detach the snap ring 48. Additionally, the following configuration is also applicable: bolt holes are formed on the outer periphery of the snap ring cover 52 and bolts are fitted into the bolt holes, and the bolts are tightened, so that the outer periphery of the retainer ring attaching part 46 is pressed by the tips of the bolts so as to fix the snap ring cover 52.

As described above, according to the present invention, the retainer ring can be attached and detached with a single motion by using a snap ring. Thus, it is possible to readily replace a retainer ring in a short time. The replacing operation has conventionally required a long time and much work.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A wafer polishing device which polishes a wafer by pressing the wafer against a rotating polishing pad, the wafer polishing device comprising:

a wafer holding head having a head body which holds the wafer;

a retainer ring attached to the head body, the wafer being surrounded by the retainer ring;

a ring-shaped retainer ring attaching part which is provided on the head body, the retainer ring being connected to a lower part of the retainer ring attaching part;

an upper depression part formed on an outer periphery of the retainer ring attaching part;

a lower depression part formed on an outer periphery of the retainer ring, the lower depression part having a rectangular shape with a base wall and a pair of sidewalls which extend perpendicularly with respect to the base wall; and a snap ring which is detachably attached to an outer periphery of a joint of the retainer ring attaching part and the retainer ring and has an upper projection part and a lower projection part formed on an inner periphery, the upper projection part being fitted to the upper depression part, and the lower projection part having a rectangular shape which corresponds to the shape of the lower depression part so as to become fitted to the lower depression part.

2. A method of attaching a retainer ring to a retainer ring attaching part of a wafer polishing device, the method comprising the steps of:

providing a retainer ring attachment part;

disposing the retainer ring below the retainer ring attaching part;

joining the retainer ring to a lower part of the retainer ring attaching part;

providing a snap ring;

sliding a snap ring cover upward relative to the snap ring so that the snap ring is fitted to the outer periphery of a joint of the retainer ring and the retainer ring attaching part, the snap ring expanding so that an upper projection part thereof is fitted to an upper depression part of the retainer ring attaching part, and a lower projection part thereof is fitted to a lower depression part of the retainer ring, the lower depression part having a rectangular shape with a base wall and a pair of sidewalls which extend perpendicularly with respect to the base wall; and sliding the snap ring cover downward relative to the snap ring so that the snap ring cover covers the outer periphery of the snap ring, thereby regulating movement of the snap ring and the retainer ring, wherein the lower depression of the retaining ring has a rectangular shape with a base wall and a pair of sidewalls which extend perpendicularly with respect to the base wall, and the lower projection of the snap ring has a rectangular shape which corresponds to the shape of the lower depression part so as to become fitted to the lower depression part.

3. A wafer-polishing device which polishes a wafer by pressing the wafer against a rotating polishing pad, the wafer polishing device comprising:

a wafer holding head having a head body which holds the wafer;

a retainer ring attached to the head body, the wafer being surrounded by the retainer ring;

a ring-shaped retainer ring attaching part which is provided on the head body, the retainer ring being connected to a lower part of the retainer ring attaching part;

an upper depression part formed on an outer periphery of the retainer ring attaching part;

a lower depression part formed on an outer periphery of the retainer ring;

a snap ring which is detachably attached to an outer periphery of a joint of the retainer ring attaching part and the retainer ring and has an upper projection part and a lower projection part formed on an inner periphery, the upper projection part being fitted to the upper depression part, and the lower projection part being fitted to the lower depression part, wherein an outer periphery of the retainer ring attaching part is provided with a cover which covers an outer periphery of the snap ring; and wherein the cover is provided so as to slide upward from a position for covering the outer periphery of the snap ring.

4. The wafer polishing device according to claim 3, wherein the retainer ring attaching part has a holding mechanism which is engaged to the cover having slid upward from the position for covering the outer periphery of the snap ring and which holds the cover at the upper position.

5. A wafer polishing device which polishes a wafer by pressing the wafer against a rotating polishing pad, the wafer polishing device comprising:

a wafer holding head having a head body which holds the wafer;

a retainer ring attached to the head body, the wafer being surrounded by the retainer ring;

a ring-shaped retainer ring attaching part which is provided on the head body, the retainer ring being connected to a lower part of the retainer ring attaching part;

an upper projection part formed on an outer periphery of the retainer ring attaching part;

a lower projection part formed on an outer periphery of the retainer ring; and a snap ring which is detachably attached to an outer periphery of a joint of the retainer ring attaching part and the retainer ring and has an upper depression part and a lower depression part formed on an inner periphery, the upper depression part being fitted to the upper projection part, and the lower depression part being fitted to the lower projection part.

6. The wafer polishing device according to claim 5, wherein:

an outer periphery of the retainer ring attaching part is provided with a cover which covers an outer periphery of the snap ring; and the cover is provided so as to slide upward from a position for covering the outer periphery of the snap ring.

7. The wafer polishing device according to claim 6, wherein the retainer ring attaching part has a holding mechanism which is engaged to the cover having slid upward from the position for covering the outer periphery of the snap ring and which holds the cover at the upper position.

* * * * *